United States Patent [19]

Kashiwagi et al.

[11] Patent Number: 4,547,640

[45] Date of Patent: Oct. 15, 1985

[54] ELECTRICAL CONTACT STRUCTURE OF A VACUUM INTERRUPTER

[75] Inventors: Yoshiyuki Kashiwagi, Tokyo; Takamitsu Sano, Yokohama; Kaoru Kitakizaki, Tokyo, all of Japan

[73] Assignee: Kabushiki Kaisha Meidensha, Japan

[21] Appl. No.: 428,237

[22] Filed: Sep. 29, 1982

[30] Foreign Application Priority Data

Oct. 1, 1981 [JP] Japan ..... 56-156469
Mar. 5, 1982 [JP] Japan ..... 57-34939

[51] Int. Cl.[4] ..... H01H 33/66

[52] U.S. Cl. ..... 200/144 B; 200/262; 200/267; 200/268; 200/269

[58] Field of Search ..... 200/144 B, 262, 264, 200/267, 268, 269, 275

[56] References Cited

U.S. PATENT DOCUMENTS

| | | | |
|---|---|---|---|
| 3,327,081 | 6/1967 | Pflanz | 200/144 B |
| 3,592,987 | 7/1971 | Lempert et al. | 200/144 B |
| 3,614,361 | 10/1971 | Weston | 200/166 C |
| 3,852,879 | 12/1974 | Krock et al. | 200/144 B |
| 3,946,179 | 3/1976 | Murano et al. | 200/144 B |
| 4,324,960 | 4/1982 | Aoki et al. | 200/144 B |

*Primary Examiner*—Robert S. Macon
*Attorney, Agent, or Firm*—Lowe, King, Price & Becker

[57] ABSTRACT

An electrical contact structure of a vacuum interrupter wherein a pair of electrical contacts 2 are provided within a vacuum vessel 1 through a pair of contact rods 14 so that one is in contact with the other or away therefrom. The electrical contact 2 comprises a substantially disk-shaped contact body **2*b* made of high electric conducting metal portions and metallic pipes having a low electric conductivity, and a plurality of major current flowing sections 22 made of metal having a high electric conductivity, penetrated in the contact body 2*b* in a manner to be penetrated in the direction of the thickness of the contact body 2*b* and separated from each other. As an alternative form, the electrical contact 2 may comprise a substantially disk-shaped contact body 2*b* of ceramic pipes 21 having a low electric conductivity and a plurality of penetrating portions (21*a*, 21*d*) wherein each portion (21*a*, 21*d*) along the inner and outer periphery of which a chromium oxide film 21*b*, 21*c* is formed, is filled with copper to form a plurality of major current flowing portions 22. As a further alternative form, the electrical contact 2 may comprise a substantially disk-shaped contact body 2*b* of ceramic pipes 21 having a low electric conductivity and a plurality of penetrating portions 21*a*, 21*d* and a plurality of major current flowing portions 22*a*** formed by filling copper containing a chromium oxide material of about 0.1% to 0.6% by weight.

18 Claims, 17 Drawing Figures

ELECTRICAL CONTACT STRUCTURE OF A VACUUM INTERRUPTER

BACKGROUND OF THE INVENTION

The present invention relates to an electrical contact or electrode structure of a vaccuum interrupter.

Generally, a pair of electrical contacts or electrodes of a vacuum interrupter are disposed within a vacuum vessel through a pair of contact rods for selective contact with each other. The contacts are formed as substantially disk-shaped elements of copper or copper alloy, respectively. The mechanical strength of this electrical contact is relatively low since a plurality of slots or slits are provided in the contact.

Vacuum interrupters in which the aforesaid contacts are utilized are generally two types. One is a magnetic driving type that improves an interrupting performance by driving an arc utilizing a magnetic force. The other is an axial magnetic field type that improves interrupting performance by applying an axially oriented magnetic field parallel to an arc thereto, causing the arc to be dispersed in a stabilized manner to prevent concentration thereof. A typical magnetic drive type electrode of a vacuum interrupter is disclosed in U.S. Pat. No. 4,324,960 issued Apr. 13, 1982, wherein the electrode has a plurality of circular arc-shaped slots extending radially and circumferentially through a tapered portion of the electrode and terminating at a flat portion thereof.

The axial magnetic field type electrode of the vacuum interrupter is disclosed in U.S. Pat. No. 3,946,179 issued Mar. 23, 1976, wherein the electrode has a plurality of slits extending from the outer periphery thereof toward the central portion thereof.

Due to the number of slits or slots, both electrodes discussed supra wear easily and are not of long endurance because of the mechanical shock energy they are exposes to when placed between open and closed conditions. In either aforesaid type of electrode, in addition to the above-mentioned low mechanical strength of the electrical contact, the mechanical strength thereof is further lowered by annealing or brazing the contact rods to the contact elements. Further, in the electrode of the magnetic driving type vacuum interrupter, there are plural spiral slots defining electric arc segments likely to deform. With regard to the electrical contact of the axial magnetic field type vacuum interrupter, the electrical contact is provided with a plurality of slits formed radially for preventing an axially oriented magnetic field interlinks with the electrical contact; however, there occurs an eddy current in the electrical contact, resulting in a lowering of the interrupting performance. This construction also results in a lower mechanical strength.

Other prior art publications relevent to electrical contact/electrode structures of vacuum interrupters are as follows:

U.S. Pat. No. 3,592,987 discloses an electrode structure of a vacuum circuit interrupter comprising a disk of gettering material on the rear side of one or both of the separable contacts to absorb gas produced during opening and closing contact of the electrodes. The electrode structure consists of fibers of gettering material embedded in a matrix of material of good conductivity.

U.S. Pat. No. 3,614,361 discloses an electrode structure comprising a relatively flat disk made of high-cathode drop material, and spiral slots extending inwardly from the periphery of the contact filled with solid low-cathode drop material, facilitating arc rotation to effect arc extinguishment.

It is clear that these references are not directed to an improvement in a mechanical strength of the electrical contact or electrode, but solely teach electrode structures different from that of the invention which will be referred to later in greater detail.

SUMMARY OF THE INVENTION

An object of the present invention is to provide an electrical contact structure of a vacuum interrupter of improved mechanical strength.

Another object of the present invention is to provide an electrical contact structure of a vacuum interrupter wherein, when applied to an axial magnetic field type by combining a coil member therewith, in respect of the electric conductivity, the electrical contact has an anisotropy in the electric current flowing direction and in the direction perpendicular thereto, thereby making it possible to suppress an electric eddy current.

Another object of the present invention is to provide an electrical contact structure of a vacuum interrupter wherein, when the electrical contact is formed with a contact body made of a highly electrically conductive material and magnetic material, and is applied to the axial magnetic type, in respect of both the conductivity and the magnetic permeability, the electrical contact has an anisotropy in the above-mentioned respective directions, thereby making it possible to effectively utilize the axial magnetic field, in addition to the suppression or prevention of an electric eddy current.

Another object of the present invention is to provide an electrical contact structure of a vacuum interrupter making it possible to remarkably improve electric current flowing capacity.

Another object of the invention is to provide an electrical contact structure of a vacuum interrupter capable of improving the connecting strength between a low electrically conductive portion and electric current flowing sections integrally formed therewith.

Another object of the invention is to provide an electrical contact structure of a vacuum interrupter wherein, when the electrical contact is formed with a plurality of bundled or binded pipes made of ceramics or high electric conductive metal, e.g., copper, filled into each pipe and between pipes, it has a high mechanical strength, and an anisotropy in the above-mentioned directions, thereby making it possible to effectively suppress an electric eddy current.

Another object of the invention is to provide an electrical contact structure of a vacuum interrupter wherein, the electrical contact is formed with a honeycomb-shaped member, having a plurality of bores therein, made of ceramics or metal, and with high electrical conductivity metal, e.g., copper filled into each bore. Thus, the contact structure has a high mechanical strength, and an anisotropy in the above-mentioned directions, thereby making it possible to effectively suppress an electric eddy current.

Another object of the invention is to provide an electrical contact structure of a vacuum interrupter comprising a substantially disk-shaped contact body having low electrically conductive portions made of ceramics and a plurality of penetrating bores filled with copper containing chromium so as to form a plurality of major current flowing sections, thereby making it possible to facilitate the fabrication thereof in addition to the above-mentioned advantages.

As one aspect of the invention, there is provided an electrical contact structure of a vacuum interrupter wherein a pair of electrical contacts are provided within a vacuum vessel through a pair of contact rods. Each electrical contact is formed with a plurality of bundled or binded pipes made of ceramics or metal, copper being filled into each pipe and between pipes.

In accordance with another aspect of the invention, there is provided an electrical contact structure of a vacuum interrupter wherein the electrical contact is formed with a honeycomb shaped-disk member having a plurality of bores therein, the disk member being made of ceramics or metal, with high electrical conductivity metal, e.g., copper, being filled into each bore.

As a further aspect of the invention, there is provided a contact structure of a vacuum interrupter wherein the electrical contact is formed with a contact body made of ceramics having a plurality of penetrating portions along which a film of chromium oxide is applied to form a major electric current flowing portion by filling copper into each penetrating portion.

In another aspect of the invention, there is provided a contact structure of a vacuum interrupter wherein the electrical contact is formed with a contact body made of ceramics having a plurality of penetrating portions to form a major electric current flowing portion by filling copper containing chromium into each penetrating portion.

BRIEF DESCRIPTION OF DRAWINGS

The features and advantages of an electrical contact structure of a vacuum interrupter according to the present invention will become more apparent from the following description taken in conjunction with the accompanying drawings, in which.

In these drawings, the same reference numerals denote the same or similar parts, respectively.

DETAILED DESCRIPTION OF THE PREFERRED EMBODIMENTS

The detail of the embodiments according to the present invention will be explained with reference to drawings.

Figure 1:
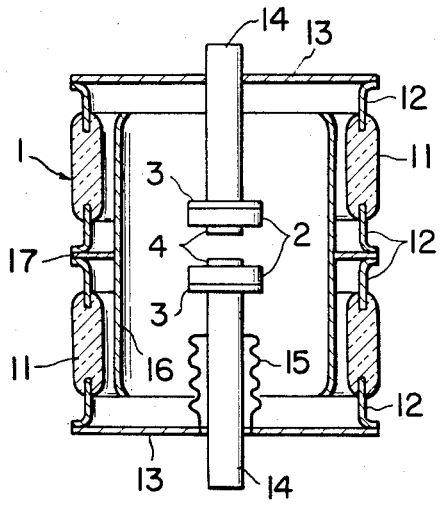
FIG. 1 is a longitudinal cross sectional view of a vacuum interrupter having an electrical contact according to the present invention.

Referring to FIG. 1, there is shown a vacuum interrupter with the provision of an electrical contact or electrode structure according to the present invention. This vacuum interrupter comprises a: A single electric insulating envelope formed by coaxially joining a plurality of cylindrical insulating envelopes 11 of glass or ceramics through sealing metal fittings 12 positioned on the one side thereof provided at both ends of the insulating envelope 11. A vacuum vessel 1 is formed by hermetically enclosing the other (opening) end of the single insulating envelope 11 with disk-shaped metallic end plates 13 through sealing metal fittings 12 positioned on the other side thereof, and then evacuating the interior thereof to a high vacuum. The vacuum interrupter is formed by introducing into the interior a pair of contact rods 14 and 14 from the central portion of each end plate 13 with the sealing of the vacuum vessel 1 being maintained so that a pair of electrical contacts or electrodes 2 selectively contact each other within vacuum vessel 1 as discussed below.

A bellows 15 allows movement of the movable contact rod 14 within the vacuum vessel 1 while maintaining sealing conditions. A cylindrical arc-shield member 16 with intermediate portions supported by metal fittings 17 is interposed between sealing metal fittings 12 positioned on one side thereof.

Figure 2:
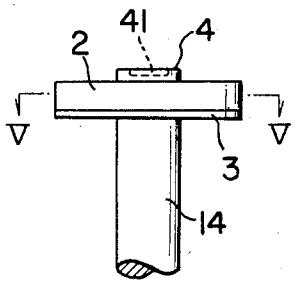
FIG. 2 is a front view of an embodiment of an electrical contact structure according to the present invention in use with a magnetic driving type vacuum interrupter.

As shown in FIGS. 1 and 2 illustrating the electrical contact structure applied to a magnetic driving type vacuum interrupter, the electrical contact 2 is formed with an outer radius larger than that of the contact rod 14 and is substantially disk-shaped. The electrical contact 2 is coaxially joined to the inner end portion of the contact rod 14 through a disk-shaped electric current bypassing conductive member 3 (which will hereinafter "current bypassing conductor") having an outer radius substantially equal to that of the electrical contact 2. On the central portion of the contact surface (the upper surface in FIG. 2) thereof, a ring-shaped contact member 4 or button-shaped contact member 4 with a recess 41 is joined.

Figure 3:
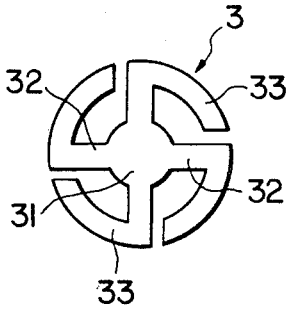
FIG. 3 is a plan view of an electric current bypassing member in use with a magnetic driving type vacuum interrupter.
Figure 4:
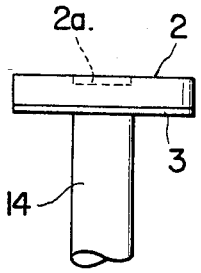
FIG. 4 is a front view of a modification of the electrical contact structure shown in FIG. 2.

The current bypassing conductor 3 bypasses a current flowing from the contact rod 14 to the electrical contact 2 to provide an anisotropy in regard to an electric conductivity as discussed below. As shown in FIG. 3, the current bypassing conductor 3 may comprise a circular central portion 31, a plurality of arms 32 outwardly extending in the radial direction from the position divided equally along the outer periphery of the central portion 31, a plurality of circular arc portions 33 curved so as to be circular arc from the end portion of each arm 32 in the direction of the same periphery with the radius of the electrical contact 2 being as a curvature radius. The shape thereof is not limited to the disk shape. Alternately, the current bypassing conductor 3 may comprise a plurality of pedals extending in the outer direction from the joining portion in a spiral manner. The contact member 4 is not necessarily required. For instance, as shown in FIG. 4, the contact member may be provided with a circular recess 2*a* in the central portion of the contact surface of the electrical contact 2, thereby causing to flow a current in a ]-shaped to obtain a magnetic driving force.

Figure 5:
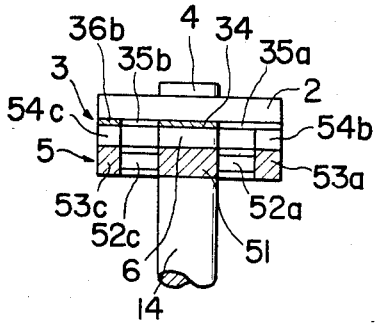
FIG. 5 is a front view partly cut away illustrating an electrical contact structure according to the present invention in use with an axial magnetic field type vacuum interrupter.
Figure 6:
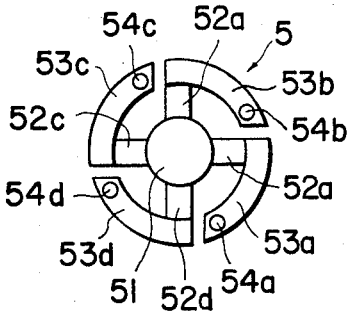
FIGS. 6 and 7 are plan views illustrating a coil member and an electric current bypassing conductive member applied to an axial magnetic field type vacuum interrupter, respectively.

FIG. 5 is a front view partly cut away illustrating an electrical contact structure of the invention applied to an axial magnetic field type vacuum interrupter wherein the electric contact or electrode 2 according to the present invention is combined with a coil member 5 for producing an axially oriented magnetic field. The coil member 5, as shown in FIG. 6, comprises a circular central conductor 51, a plurality of arms 52*a*, 52*b*, 52*c* and 52*d* extending outwardly in the radial direction from the position divided equally along the outer periphery of the central conductor 51, circular arc portions 53*a*, 53*b*, 53*c* and 53*d* curved in a circular arc manner in the direction of the same periphery from the end portion of each arm 52*a* 52*b*, 52*c* and 52*d*, and connecting conductors 54*a*, 54*b*, 54*c*, and 54*d* extending in the axial direction in orer to connect the end portions of the circular arc portions 53*a*, 53*b*, 53*c* and 53*d* with the current bypassing conductor 3. The coil member 5 is connected to the inner end portion of the contact rod 14 at the central conductor 51.

Figure 7:
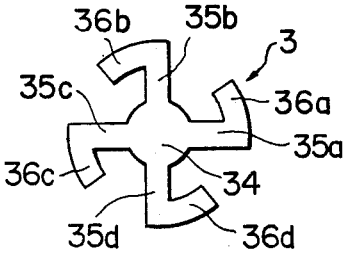

The electrical contact 2 shown in FIG. 7 has a current bypassing conductor comprising a central portion 34, a plurality of arms 35*a*, 35*b*, 35*c* and 35*d* extending outwardly in the radial direction from the position divided equally along the outer periphery of the central portion 34, and circular arc portions 36*a*, 36*b*, 36*c* and 36*d* curved as a circular arc with the radius of the electrical contact 2 being a curvature radius in the direction of the same periphery opposite to the circular arc portions 53*a*, 53*b*, 53*c* and 53*d* of the coil member 5 from the end portion of each of arms 35*a*, 35*b*, 35*c* and 35*d* is mounted to the coil member 5. A resistance spacer 6 of a low electric conductivity, such as stainless steel or ceramics, is interposed between the central electric conductor 51 of the coil member 5 and the central portion 34 of the current bypassing conductor 3. Each of connecting conductors 54*a*, 54*b*, 54*c* and 54*d* is connected to each of circular arc portions 36*d*, 36*a*, 36*b* and 36*c* of current bypassing conductor 3, respectively. In FIG. 5, reference numeral 4 denotes a disk-shaped contact member joined to the central portion of the contact surface of the electrical contact 2.

Figure 8:
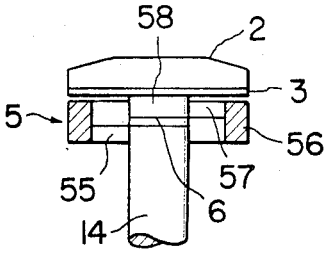
FIG. 8 is a front view partly cut away illustrating another embodiment of an electrical contact structure of the invention applied to an axial magnetic field type vacuum interrupter.

In the axial magnetic field type vacuum interrupter, the electrical contact 2 and the coil member 5 are not limited to the above-mentioned construction. For instance, as shown in FIG. 8, the electrical contact 2 is formed with an umbrella shaped circular plate. The current bypassing conductor 3 may be formed with a circlar, or spiral plate, as is in the case of the above-mentioned magnetic dirving type vacuum interrupter. The coil member 5 may comprise one or more than two first arms 55 extending outwardly in the radial direction from the outer peripheral portion in the vicinity of the inner end of the contact rod 14, a circular arc portion 56 curved so as to present a circular arc with the radius of the electrical contact 2 being as a curvature radius, a second arm 57 extending inwardly in the radial direction from the end portion of the circular arc portion 56, and an electrically connecting member 58 joined to the end portion of the second arm 57 and the inner end surface of the contact rod 14 through the resistance spacer 16.

Figure 9:
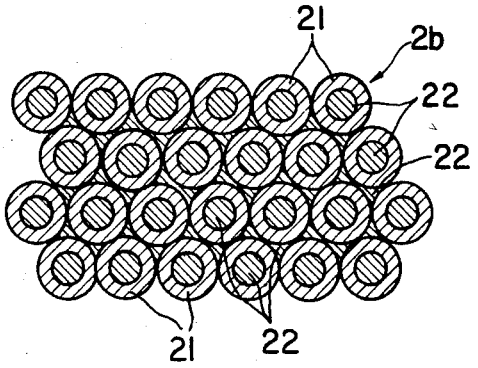
FIG. 9 is an enlarged cross sectional view showing the contact body of the electrical contact taken along V—V line in FIG. 2.

The electrical contact 2 of the invention comprises as shown in FIG. 9, a disk-shaped contact body serving as a semi-resistor, wherein FIG. 9 shows a portion of the disk-shaped semi-resistor 2*b*. The contact body 2*b* comprises pipes 21 made of material having a low electric conductivity, and a plurality of sections 22 made of metal having a high electric conductivity formed so as to bundle or bind pipes 21 together and penetrate into each pipe 21 and gaps between the pipes 21. The contact body 2*b* will hereinafter be referred to as a "semi-resistor" and the sections 22 are hereinafter termed "major electric current flowing portions."

The semi-resistor 2*b* constituting the body of the electrical contact 2 is formed with a high electrically conducting of material and a low electrically conducting metal ceramics whose specific electric resistance is more than 5 $\mu$·cm. The material 22 of high electrical condictivity is metal having an electrical conductivity higher than that of the material 21 of low electrical conductivity. As a low electrically conducting metal having a specific electric resistance larger than 5 $\mu$·cm, a non-magnetic material, such as, stainless steel of austenite, or a magnetic material, such as, stainless steel of ferrite, iron (Fe), nickel (Ni), or cobalt (Co) is used. As a metal forming the major current flowing section 22 of the electrical contact 2, for instance, copper (Cu), silver (Ag), alminium (Al), copper (Cu) alloy or silver (Ag) alloy having a melting point lower than that of the electrically conducting metal of the semi-resistor 2*b* and high electric conductivity is used. The area of the major current flowing section 22 of the semi-resistor 2*b* is selected to be 10% to 90% in a cross section cut in the current flowing direction on the basis of electric capacity and the mechanical strength.

In the electrical contact 2 thus constructed, a method of fabricating the semi-resistor 2*b* comprises the steps of joining a plurality of metallic or ceramics pipes 21, as shown in FIG. 9, having a circular cross section and an outer radias of 0.1 mm to 10 mm in such a manner they are bundled or binded to be formed circular in cross section, accommodating the plurality of metallic pipes 21 within a cylindrical vessel (not shown) of ceramics, immersing a metal of high electric conductivity, for example, copper (Cu) into a hollow portion of each metallic or ceramic pipe and a gap between adjacent pipes. The method further comprises the steps of forming a block of semi-resistor 2*b*, and machining the block to form a predetermined size of the electrical contact 2.

The shape of the metallic or ceramic pipe 21 is not limited to a circular cross section. For instance, the shape thereof may be a triangle, or polygon, such as hexagon. The construction thereof is not limited to a tubular or pipe member.

Another method of fabricating an electrical contact 2 (semi-resistor 2*b*) comprises the steps of forming a honeycomb-shaped disk of a low electrically conducting metal or ceramics with a plurality of bores spaced from each other so that a high electrically conductive metal is penetrated in the direction of the thickness thereof. In this instance, reference numeral 21 denotes a portion including the honeycomb portion.

As is clear, in accordance with the above-mentioned embodiment, in a pair of electrical contact structure of a vacuum interrupter provided within a vacuum vessel through a pair of contact rods so that one is in contact with the other or away therefrom, a plurality of major current flowing sections 22 of metal have a high electric conductivity, and each is spaced to each other so as to be penetrated in the direction of the thickness. Accordingly, this embodiment makes it possible to remarkably increase the mechanical strength of the electrical contact as compared with the prior art electrical contact structure. Particularly, when the electrical contact is applied to the axial magnetic field type vacuum interrupter by combining the coil member for producing the axially oriented magnetic field therewith, in respect of the electric conductivity, the electrical contact or electrode 2 has a anisotropy in the electric current flowing direction and the direction perpendicular thereto. As a result, this makes it possible to suppress an electric eddy current. Further, in an electrical contact wherein the semi-resistor **2*b* is made of a high electrically conducting metal and a magnetic metal, the electrical contact 2** has an anisotropy in regard to the electric conductivity and a magnetic permeability. Accordingly, in addition to the suppression of the electric eddy current, this embodiment makes it possible to effectively utilize the axially oriented magnetic field.

Figure 10:
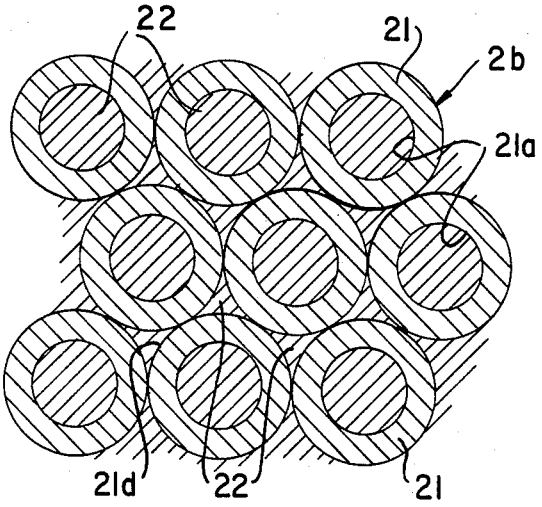
FIG. 10 is a enlarged cross sectional view illustrating another embodiment of the contact body shown in FIG. 9
Figure 10A:
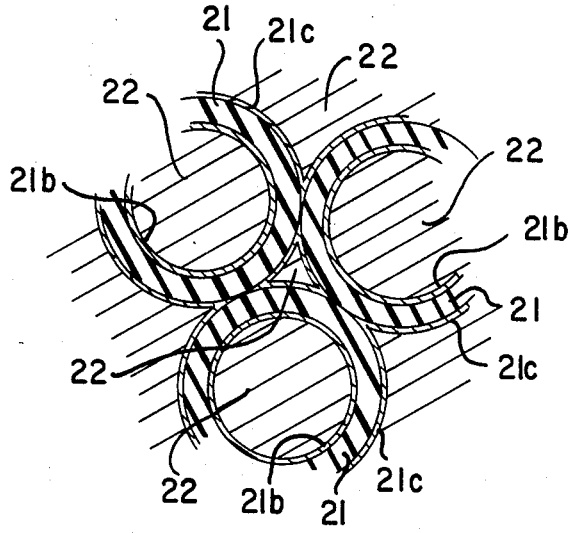
FIG. 10A is an enlarged fragmentary cross section of FIG. 10.

Reference is made to the second embodiment of the invention with reference to FIGS. 2, 10 and 10A wherein FIG. 10 shows a portion of the semi-resistor **2*b***.

The electrical contact 2 is constituted by providing a plurality of penetrating portions **21*a* and 21*d* penetrating in the direction perpendicular to the disk surface of the semi-resistor 2*b* and spaced to each other in a body portion of the disk-shaped semi-resistor 2*b* of a high electrically conducting metal and ceramic pipes containing alumina, mullite ($3Al_2O_3.2SiO_2$), zircon ($ZrSiO_4$), steatite, forming a film or coating 21*b*, 21*c* of chromium oxide, such as ($Cr_2O_3$) having a thickness larger than 0.1 μm along the inner and outer peripheral surfaces of each penetrated pipe 21, and filling copper into each penetrating section 21*a*, 21*d* in which the film 21*b*, 21*c* of chromium oxide is formed by means of an immersion, thereby to form a plurality of major current flowing sections 22**.

The area of each major current flowing section 22 of the resistor **2*b* is provided so as to be 10% to 90% in cross sectional area of the electrical contact 2** perpendicular to the current flowing direction in accordance with the current flowing capacity and the mechanical strength.

A method of fabricating electrical contacts 2 thus constructed is as follows:

First, a plurality of circular pipes of ceramics containing alumina, or mullite wherein the length thereof is substantially the same as that of the thickness of desired electrical contact, the inner radius thereof is larger than 0.1 mm and the outer radius thereof is larger than 0.3 mm, are bundled or binded to be circular-plate shaped with a suitable binding member (for instance, provisionally a fixing band). Then chromium is vacuum-evaporated to the whole surface of the pipes thus bundled or binded (the inner and outer peripheral surfaces of each pipe) so that the thickness of the film of chromium is thicker than 10 nm (nano meter)=(100 Å). Alternately, a chromium is plated thereto so that the thickness of the film is larger than 0.1 μm. Thereafter, heating is continuously effected for ten minutes at a temperature more than 100° C. in an atmosphere of air and a pressure higher than $10^{-4}$ Torr. An oxidation treatment thus occurs to form a film or coating of chromium oxide material on the whole surface of pipes bundled or binded. Then, a block of copper is mounted on disk-shaped bundled or binded pipes on which a film of the chromium oxide material is formed such that the hollow portion of each pipe is disposed vertically. Next, the above intermediate construction is placed in a vacuum (e.g. vacuum furnace) having a pressure less than $10^{-4}$ Torr or in an atmosphere of gas, such as, helium, or hydrogen, preventing oxidation of copper. Finally the disk-shaped bundled or binded pipes on which the block of copper is mounted is heated to a temperature greater than the melting point of copper, that is, more than 1083° C. in the above-mentioned atmosphere. The melted copper flows and penetrates the hollow portion of each pipe and the penetrating gaps (penetrating bores) formed between adjacent pipes.

The disk-shaped bundled or binded pipes into which copper pentrates in the above-mentioned atmosphere is gradually cooled. Then, the desired electrical contact 2 is completed.

In the above-mentioned fabricating method, after the pipes of ceramics are bundled or binded to be disk-shaped, the film of chromium oxide material is formed. However, the fabricating method is not limited to this method. For instance, another method may be used, which comprises the steps of forming in advance a chromium oxide material on the whole surface (inner and outer peripheral surfaces) of each ceramic pipe, and thereafter bundling or binding the pipes so as to be formed disk-shaped.

The formation of the film of chromium oxide material is not limited to the above-mentioned method. For instance, another method of forming a film of chromium oxide material may be used, which comprises the steps of vacuum-depositing a chromium oxide on the whole surface of each pipe or the binded pipes so that the thickness of the film is more than 10 nm (100 Å), or painting a powder of a paste of a chromium oxide of −100 mesh thereon by means of a suitable solvent so that the thickness of the film is 0.1 μm, thereby forming the film of chromium oxide material.

Further, the shape of the pipe of ceramics is not limited to circular shape. For instance, the shape thereof may be polygon, such as triangle, quadrangle, or hexagon or elliptic.

Another method of fabricating semi-resistor **2*b*** comprises the steps of forming a substantially disk-shaped, for example, honeycomb shaped ceramics with a plurality of penetrating bores and penetrating a high conducting metal (Cu) into bores in the direction perpendicular to the body surface and spaced to each other in the ceramics.

Figure 11:
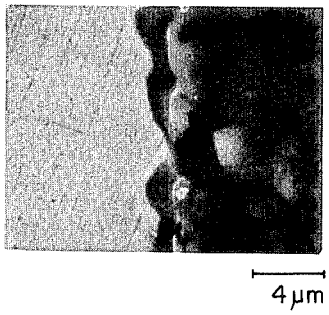
FIGS. 11 to 15 are photos illustrating a joining portion between the low electric conducting portion of ceramics and the major electric current-flowing sections in connection with the contact structure shown in FIG. 10.
Figure 12:
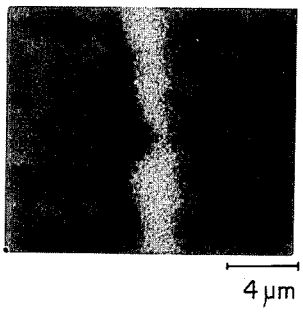
Figure 13:
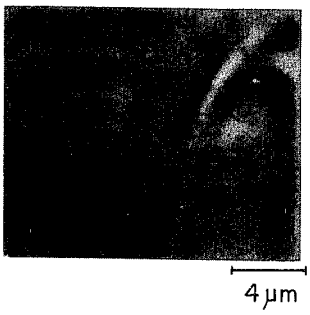
Figure 14:
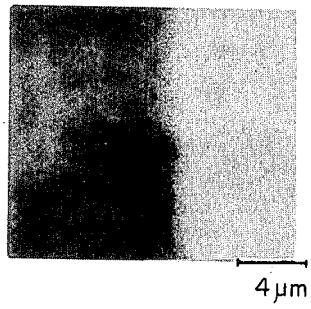
Figure 15:
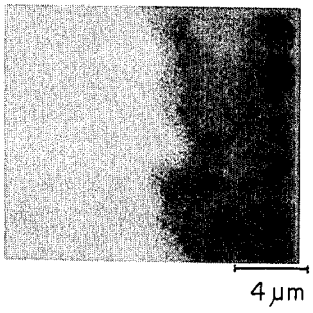

It is observed that the state of joined portions between the ceramics and copper constituting the major current flowing section 22 of the electrical contact 2 fabricated by the above-mentioned method is indicated in an enlarged view (grain boundary view) shown in FIGS. 11, 12, 13, 14 and 15 in the case of the following method;

The method of fabricating the semi-resistor **2*b* comprises the steps of binding a plurality of pipes of alumina ceramics, forming a film of chromium having about 1 μm on the whole surface thereof by means of a vacuum deposition, heating it for ten minutes at a temperature of about 500° C. in an air whose pressure is $10^{-3}$ to $10^{-4}$ Torr to form a film of chromium oxide material, thereafter immersing copper into the hollow portion of each pipe and the gaps between bundled or binded pipes in the atmosphere of vacuum whose pressure is $10^{-4}$ to $10^{-5}$ Torr at a temperature more than 1083° C., and gradually cooling in the same atmosphere. That is, FIG. 11 is a secondary electron image obtained with an X-ray micro analizer wherein the portion of black positioned on the right hand denotes an alumina ceramics, the portion of somewhat white denotes a copper, and the waved portion located in the boundary therebetween denotes a chromium oxide material. FIG. 12 is a characteristic X-ray image obtained with an X-ray microanalyzer showing the dispersion state of chromium wherein the portion of white denotes chromium. Further, FIG. 13 is a characteristic X-ray image obtained with an X-ray microanalyzer showing the dispersing state of an oxygen wherein the portion of white denotes an oxygen dispersed on the right hand. FIGS. 14 and 15 are characteristic X-ray images obtained with X-ray microanalizer showing the dispersion state of aluminum and copper, respectively, wherein the portion of white on the right hand in FIG. 14 denotes an aluminium, and the portion of white on the left hand in FIG. 15 denotes copper. The semi-resistor 2***b* has been formed that the joining strength between the ceramics 21 and the major current flowing section 22 of the electrical contact 2 fabricated with the above-mentioned method, that is, the joining strength between the copper and the ceramics is 5 kg/mm$^2$.

The following points are confirmed by experiment: One is that in connection with the film of chromium formed on each pipe of ceramics or the bundled or binded pipes thereof, the uniform thickness of the film is at least more than 10 nm (100 Å) by means of a vacuum deposition.

Second is that in connection with the joining to copper, the desired joining strength is obtained by means of a uniform diffusion of chromium (into both ceramics and the copper).

Third is that in connection with the plating, a uniform diffusion layer cannot be obtained unless the thickness of the film is at least more than 0.1 μm.

Likewise, it is confirmed by an experiment that in the case of forming a film of chromium oxide material by painting a powder of a paste of chromium oxide of −100 mesh, the desired joining strength cannot be obtained, unless the thickness of the film more than 0.1 μm is painted.

The condition required for oxidation treatment of chromium film depends on the thickness of the film. The above-mentioned conditions 10$^{-4}$ Torr, 100° C., ten minutes) at the minimum thickness of film (about 0.1 μm) is at least required. It appears that the reason for this is that the chromium is easily changed to a chromium oxide with the aid of a bit amount of an oxygen in an air since the chromium has a large affinity with respect to the oxygen.

Figure 16:
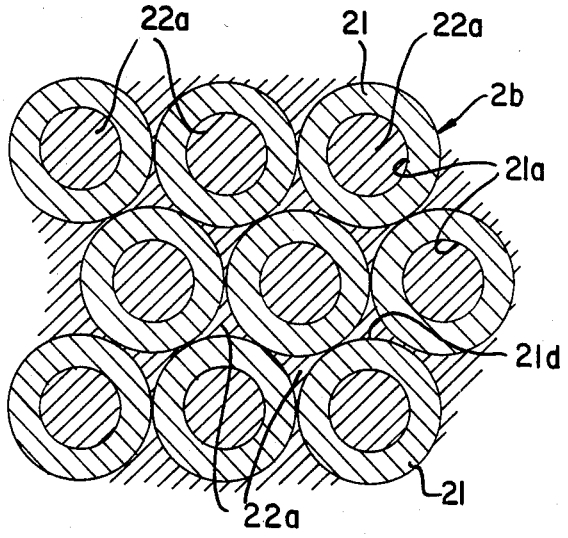
FIG. 16 is an enlarged transverse cross sectional view illustrating a modification of the contact body shown in FIG. 10.

Referring to FIG. 16, there is shown illustrating a modification of the electrical contact structure shown in FIG. 10 wherein FIG. 16 shows a portion of the resistor 2*b*.

The electrical contact 2 of the FIG. 10 embodiment comprises a disk-shaped semi-resistor 2*b* made of high electrically conducting metal and ceramic pipes provided with a plurality of penetrating sections 21*a* penetrated in the direction perpendicular to the contact surface and spaced to each other for a suitable distance, and a plurality of major current flowing sections 22 of copper immersed into the penetrating section 21*a* and gaps 21*d* of ceramic pipes and filled therein. According to the preceding embodiments in order to increase the joining strength between the copper and the ceramics, the film 21*b*, 21*c* of chromium oxide material is formed along the inner and outer peripheral surfaces of each penetrating ceramic pipe 21. In contrast to this, the electrical contact of the present embodiment is constituted by filling copper containing chromium of 0.1% to 0.6% by weight into each penetrating section 21*a*, 21*d* of the disk-shaped semi-resistor 2*b* made of a high electrically conducting metal and ceramic pipes without chromium oxide coated film by means of an immersing thereby to form a plurality of major current flowing sections 22*a*.

A method of fabricating the electrical contact according to the above-mentioned embodiment comprises the steps of, similar to that of the FIG. 10 embodiment, first, bundling or binding a plurality of pipes of ceramics, such as, alumina with a binding member so that they are formed to be substantially disk-shaped, arranging the disk-shaped binded pipes so that the hollow portion of each pipe is disposed in the upper and lower directions, mounting a block of copper containing chromium of about 0.1% to 0.6% by weight on the upper end thereof, accommodating it in the atmosphere of vacuum (in a vacuum furnace) whose pressure is less than $10^{-4}$ Torr or in the gaseous atmosphere, such as, helium or hydrogen which does not cause to oxide copper through a cylindrical vessel of ceramics, and finally heating them in the above atmosphere at a temperature more than a melting point of copper to immerse copper containing chromium of 0.1% to 0.6% by weight into the hollow portion of each pipe and the gaps between adjacent pipes and gradually cool them in the same atmosphere, thereafter to complete the desired shaped electrical contact by machining.

In the above-mentioned fabricating method, reference has been made to the case that the semi-resistor 2*b* is formed by bundling or binding a plurality of circular pipes of ceramics. However, the fabricating method is not limited to this method. For instance, similar to that of above-mentioned embodiments, there is no doubt that polygon pipes of ceramics are bundled or binded and the semi-resistor is formed with a honeycomb shaped disk or plate of ceramics having a plurality of penetrating bores penetrating in the direction perpendicular to the plate surface thereof and spaced to each other.

In the above-mentioned respective embodiments, reference has been made to the electrical contact for a vacuum interrupter of the magnetic driving type vacuum interrupter. Further, the type of the vacuum interrupter is applicable to the axial magnetic field type. Namely, it is possible to make an electrical contact 2 for a vacuum interrupter of the axially oriented magnetic field, which is combined with the coil member 5 for producing an axially oriented magnetic field as stated above with reference to FIGS. 5 to 8.

Reference has been made to the case that the electrical contact 2 of each embodiment stated above is applied to the vacuum interrupter of the magnetic driving type or the axially oriented magnetic field wherein the vacuum interrupter includes a vacuum vessel constituted by forming a single envelope by means of joining a plurality of insulating envelope 11 in series, hermetically joining the both opening ends of the insulating envelope with the metallic end plate 13, and evacuating the interior thereof to a high vacuum. However, the vacuum vessel 1 applied to these vacuum interrupters is not limited to them. For instance, another vacuum vessel may be used, which is constituted by hermetically enclosing the both opening ends of a single insulating envelope of glass or ceramics directly or through a sealing metal fitting with a metallic end plate. There are other two types of vacuum vessel constituting a vacuum interrupter of the magnetic driving type or axially driving type applicable to the electrical contact of the invention. One is to hermetically enclose the opening ends of a tubular member of metal with an end plate of an insulating material, such as, ceramics, thereby to form a vacuum vessel. The other is to hermetically enclose the opening of a cylindrical member with a bottom portion (cup-shaped member) with an insulating end plate thereby to form a vacuum vessel.

As stated above, in accordance with above-mentioned embodiment, a substantially disk-shaped semi-resistor made of a high electrically conducting material and ceramic pipes is provided with a plurality of penetrating bores penetrating in the direction perpendicular to the plate surface of the semi-resistor with each being spaced to each other, a film or coating of chromium oxide material being formed along the inner and outer peripheral surfaces thereof, and copper is filled into each penetrating section to form a plurality of conductive portions. Accordingly, the present embodiment makes it possible to improve a current capacity to a great extent, and to rapidly increase the mechanical strength in addition to an improvement in joining strength between the resistor portion and the each current flowing portion without the chromium oxide film.

Particularly, when the electrical contract of the invention is combined with the coil member for producing an axially oriented magnetic field in a vacuum interrupter of the axially oriented magnetic field, there exists an anisotropy in regard to a conductivity and a magnetic permeability in the direction of current-flowing and in the direction perpendicular thereto. Accordingly, this makes it possible to suppress that there occurs an electric eddy current and effectly utilize the axially oriented magnetic field.

The electrical contact for a vacuum interrupter is constituted as a semi-resistor by providing a plurality of penetrating sections penetrated in the direction perpendicular to the semi-resistor surface thereof and spaced to each other, and filling copper containing a chromium of about 0.1% to 0.6% by weight into each penetrating section thereby to form a plurality of current flowing portions. Accordingly, in addition to the above-mentioned advantages, the effect which makes it easy to fabricate the electrical contact will accrue.

While the preferred embodiments of the invention have been particularly shown and described, it will be apparent to those skilled in the art that modification can be without departing from the principle and the sprit of the invention, the scope of which is defined in the appended claims. Accordingly, the foregoing embodiments are to be considered illustrative, rather than restricting of the invention and range of equivalent of the claims are to be included therein.

What is claimed is:

1. An electrical contact structure of a vacuum interrupter in which a pair of electrical contacts are provided within a vacuum vessel by means of a pair of contact rods so that one electrical contact is in selective contact with the other electrical contact, wherein each of said electrical contacts comprises a substantially disk-shaped contact body and a contact portion on said contact body, said contact body including material of low electrical conductivity and material of high electrical conductivity, said high electrical conductivity materials carrying the majority of the electrical current flow through the contact body, said material of high electrical conductivity being metal having an electrical conductivity higher than that of said material of low electrical conductivity, said material of high electrical conductivity having a melting point lower than that of said material of low electrical conductivity, and said material of high electrical conductivity being formed in situ from a molten metal melted to penetrate the material of low electrical conductivity in the direction of the thickness of said contact body, the improvement wherein said contact body comprises a plurality of discrete portions of said high electrical conductivity material extending through the contact body and spaced from each other by a plurality of portions of said low electrical conductivity material, said high electrical conductivity portions being separated from each other by said low electrical conductivity portions.

2. An electrical contact structure of a vacuum interrupter as defined in claim 1, wherein said low electrically conducting portions are formed from one of metal and ceramics having a specific resistance of more than 5 $\mu\Omega$-cm.

3. A electrical contact structure of a vacuum interrupter as defined in claim 1, wherein said low electrically conducting portions is formed of a stainless steel.

4. An electrical contact structure of a vacuum interrupter as defined in claim 3, wherein said stainless steel comprises an austenite.

5. An electrical contact structure of a vacuum interrupter as defined in claim 3, wherein said stainless steel comprises a ferrite.

6. An electrical contact structure of a vacuum interrupter as defined in claim 1, wherein said low electrically conducting portion is formed of iron.

7. An electrical contact structure of a vacuum interrupter as defined in claim 1, wherein said low electrically conducting portion is formed of nickel.

8. An electrical contact structure of a vacuum interrupter as defined in claim 1, wherein said low electrically conducting portion is formed of cobalt.

9. An electrical contact structure of a vacuum interrupter as defined in claim 1, wherein said low electrically conducting portion is formed of ceramics.

10. An electrical contact structure of a vacuum interrupter as defined in claim 1, wherein said low electrically conducting portion is formed from a plurality of pipes joined to each other.

11. An electrical contact structure of a vacuum interrupter as defined in claim 10, wherein the outer radius of each said pipe is 0.1 mm to 10 mm.

12. An electrical contact structure of a vacuum interrupter as defined in claim 1, wherein said integrally formed low electrical conductivity portions have a plurality of bores filled with high conductivity material.

13. An electrical structure of a vacuum interrupter as defined in claim 1, wherein an area occupation ratio of said low electrically conducting portion existing in a cross sectional surface cut in the current flowing direction of said high electrically conducting section serving as a current carrying portion is 10% to 90%.

14. An electrical contact structure of a vacuum interrupter wherein a pair of electrical contacts are provided within a vacuum vessel through a pair of contact rods so that one is in contact with the other or separated therefrom;

the improvement wherein a substantially disk-shaped semi-resistor defining each contact body of the electrical contacts comprises a plurality of highly electrically conductive portions of copper serving as an electric current carrying portion provided in a direction perpendicular to the disk surface of said semi-resistor and separated from each other, and a plurality of low electrically conductive portions of ceramics, and a chromium oxide film formed at a boundary surface between said highly electrically conductive portions and said low electrically conductive portions.

15. An electrical contact structure of a vacuum interrupter as defined in claim 14, wherein said semi-resistor comprises a plurality of parallel bundled or binded members made of ceramics having a low electric current conductivity, said ceramic members including therein a plurality of penetrating portions provided in a direction perpendicular to the disk surface of said semi-resistor and separated from each other, a chromium oxide film formed along the inner periphery of each penetrating portion and the inner periphery of gaps defined by each outer periphery of the plurality of bundled and binded ceramic members, and a plurality of portions serving as a major electric current carrying portion formed by filling copper into each of said penetrating portions and said gaps.

16. An electrical contact structure of a vacuum interrupter wherein a pair of electrical contacts are provided within a vacuum vessel through a pair of contact rods so that one is in contact with the other or separated therefrom;

the improvement wherein a substantially disk-shaped semi-resistor defining each contact body of the electrical contacts comprises a plurality of highly electrically conductive portions of copper containing chromium of about 0.1% to 0.6% by weight serving as an electric current carrying portion provided in a direction perpendicular to the disk surface of said semi-resistor and separated from each other, and a plurality of low electrically conductive portions of ceramics.

17. An electrical contact structure of a vacuum interrupter in which a pair of electrical contacts are provided within a vacuum vessel by means of a pair of contact rods so that one electrical contact is in selective contact with the other electrical contact, wherein each of said electrical contacts comprises a substantially disk-shaped contact body and a contact portion on said contact body, said contact body including material of low electrical conductivity and material of high electrical conductivity, said high electrical conductivity materials carrying the majority of the electrical current flow through the contact body, said material of high electrical conductivity being metal having an electrical conductivity higher than that of said material of low electrical conductivity, said material of high electrical conductivity having a melting point lower than that of said material of low electrical conductivity, and said material of high electrical conductivity being formed in situ from a molten metal melted to penetrate the material of low electrical conductivity in the direction of the thickness of said contact body, the improvement wherein said contact body is formed from a honeycomb shaped member of said low electrical conductivity material having a plurality of bores filled with and to establish a plurality of portions of said high electrical conductivity material within said honeycomb shaped member, said high electrical conductivity portions being separated and isolated from each other by said low electrical conductivity portions to suppress formation of electric eddy currents within the contact body.

18. An electrical contact structure of a vacuum interrupter in which a pair of electrical contacts are provided within a vacuum vessel by means of a pair of contact rods so that one electrical contact is in selective contact with the other electrical contact, wherein each of said electrical contacts comprises a substantially disk-shaped contact body and a contact portion on said contact body, said contact body including material of low electrical conductivity and material of high electrical conductivity, said high electrical conductivity materials carrying the majority of the electrical current flow through the contact body, said material of high electrical conductivity being metal having an electrical conductivity higher than that of said material of low electrical conductivity, said material of high electrical conductivity having a melting point lower than that of said material of low electrical conductivity, and said material of high electrical conductivity being formed in situ from a molten metal melted to penetrate the material of low electrical conductivity in the direction of the thickness of said contact body, the improvement wherein said contact body comprises a plurality of bundled pipes formed of low conductivity material and formed with bores within the pipes and spaces between adjacent pipes filled with and to establish portions of said high electrical conductivity material being separated from each other by said low electrical conductivity material formed.

* * * * *